US011293222B2

(12) United States Patent
Geiger

(10) Patent No.: US 11,293,222 B2
(45) Date of Patent: Apr. 5, 2022

(54) WIRING ARRANGEMENT FOR MOTORIZED WINDOW SHADE

(71) Applicant: Geigtech East Bay LLC, Charleston, SC (US)

(72) Inventor: James Geiger, Charleston, SC (US)

(73) Assignee: Geigtech East Bay LLC, Charleston, SC (US)

( * ) Notice: Subject to any disclaimer, the term of this patent is extended or adjusted under 35 U.S.C. 154(b) by 718 days.

(21) Appl. No.: 15/876,881

(22) Filed: Jan. 22, 2018

(65) Prior Publication Data

US 2018/0209214 A1 Jul. 26, 2018

Related U.S. Application Data

(60) Provisional application No. 62/449,573, filed on Jan. 23, 2017.

(51) Int. Cl.
*E06B 9/44* (2006.01)
*E06B 9/74* (2006.01)
(Continued)

(52) U.S. Cl.
CPC ..... *E06B 9/44* (2013.01); *E06B 9/50* (2013.01); *E06B 9/60* (2013.01); *E06B 9/72* (2013.01); *E06B 9/74* (2013.01); *A47H 1/13* (2013.01)

(58) Field of Classification Search
CPC ..... E06B 9/44; E06B 9/50; E06B 9/60; E06B 9/72; E06B 9/74; A47H 1/13; B65B 19/00; B65B 2210/04; B65B 5/06
See application file for complete search history.

(56) References Cited

U.S. PATENT DOCUMENTS 2,653,710 A * 9/1953 Judd ..... B65D 85/672 206/389
4,417,185 A * 11/1983 Bullat ..... E06B 9/74 318/2

(Continued)

FOREIGN PATENT DOCUMENTS

| | | |
|---|---|---|
| BE | 1020011 | 9/2011 |
| BE | 1018808 | 3/2013 |
| EP | 1 764 474 | 3/2007 |

OTHER PUBLICATIONS

International Search Report and Written Opinion regarding Application No. PCT/US2018/014705, dated Apr. 25, 2018, 20 pps.

*Primary Examiner* — Jerry E Redman
*Assistant Examiner* — Abe Massad
(74) *Attorney, Agent, or Firm* — Kim and Lahey Law Firm LLC; Douglas W. Kim

(57) ABSTRACT

A mounting assembly for a roller window shade includes a mounting bracket, a motor coupled with a shade tube of the shade, and a wire. The mounting bracket includes a body having a first surface and a second surface and a protrusion fixedly coupled with the body and extending perpendicularly from the second surface. The first surface bears against a flat surface. A passage extends between the first surface and the second surface. The motor defines a recess that receives the protrusion. The wire extends through the passage and couples with the motor. The mounting bracket and the motor obscure the wire from view. The passage extends at least one of proximate and through the protrusion such that the wire extends into the recess when the wire is coupled with the motor and when the recess receives the protrusion.

13 Claims, 12 Drawing Sheets

(51) Int. Cl.

| | |
|---|---|
| ***E06B 9/60*** | (2006.01) |
| ***E06B 9/50*** | (2006.01) |
| ***E06B 9/72*** | (2006.01) |
| *A47H 1/13* | (2006.01) |

(56) References Cited

U.S. PATENT DOCUMENTS

| | | | | |
|---|---|---|---|---|
| 5,671,387 | A * | 9/1997 | Jacobs | B60J 1/2016 710/240 |
| 6,843,301 | B2 * | 1/2005 | Carrillo | E04F 10/0614 160/310 |
| 8,162,697 | B1 * | 4/2012 | Menolotto | H01R 13/7031 439/669 |
| 9,334,688 | B2 * | 5/2016 | Colson | E06B 9/42 |
| 9,371,687 | B2 * | 6/2016 | Yu | E06B 9/262 |
| 9,765,566 | B1 * | 9/2017 | Chen | E06B 9/42 |
| 10,294,717 | B2 * | 5/2019 | Geiger | E06B 9/50 |
| 2006/0158045 | A1 * | 7/2006 | Sped | E06B 9/72 310/1 |
| 2007/0175783 | A1 * | 8/2007 | Nien | B65B 27/10 206/320 |
| 2013/0068404 | A1 * | 3/2013 | Faller | E06B 9/322 160/310 |
| 2013/0199735 | A1 * | 8/2013 | Colson | E06B 9/80 160/2 |
| 2015/0034259 | A1 * | 2/2015 | Bohlen | E06B 9/62 160/310 |
| 2019/0162022 | A1 * | 5/2019 | Geiger | E06B 9/50 |

* cited by examiner

WIRING ARRANGEMENT FOR MOTORIZED WINDOW SHADE

CROSS-REFERENCE TO RELATED APPLICATION

This application claims the benefit of and priority to U.S. Provisional Application No. 62/449,573, filed Jan. 23, 2017, which is incorporated herein by reference in its entirety.

BACKGROUND

The present application relates generally to the field of shade tube assemblies. More particularly, the present application relates to apparatuses and methods for window shade and window tube, shipping, assembly, and installation.

Conventional apparatuses and methods for shipping, assembling, and installing shade tube assemblies are inefficient and often result in shade tube assembly installers installing shade tube assemblies that leave gaps between wall surfaces and the shade when the shade is in an extended position. For example, current shade tube assembly installers typically first visit a job site to measure areas to be covered by a shade (e.g., a window), then manufacture and assemble shade tube assemblies off-site (e.g., at a manufacturing facility or other location), and finally ship the assembled shade tube assemblies to the site for installation. Since all assembly of the shade tube assemblies is undertaken off-site, the shade tube assemblies must be manufactured with greater tolerance to ensure the shade tube assemblies fit the area to be covered once the shade tube assemblies are shipped to the installation site, thereby resulting in shade tube assemblies that cover a larger area than needed or that inadequately conceal the area intended to be covered.

SUMMARY

One exemplary embodiment relates to a mounting assembly for mounting a roller window shade, the mounting assembly including a mounting bracket, a motor configured to be coupled with a shade tube of the roller window shade, and a wire. The mounting bracket includes a body having a first surface and a second surface and a protrusion fixedly coupled with the body and extending perpendicularly from the second surface. The first surface is configured to bear against a flat surface, and the body defines a passage extending between the first surface and the second surface. The motor defines a recess configured to receive the protrusion. The wire is configured to extend through the passage and couple with the motor. The wire has a working length extending between the flat surface and the motor. The mounting bracket and the motor obscure the wire from view such that the working length of the wire is not visible to an observer when the recess of the motor receives the protrusion. The passage extends at least one of proximate and through the protrusion such that the wire extends into the recess when the wire is coupled with the motor and when the recess receives the protrusion.

Another exemplary embodiment relates to a fastening device system for mounting a roller window shade, the system including a mounting bracket, a motor configured to be coupled with a shade tube of the roller window shade, and a wire. The mounting bracket includes a base member having a first side and a second side and a protrusion fixedly coupled with the base member and extending perpendicularly from the second side. The first side is configured to bear against a flat surface. The base member defines a pocket extending inward from the first side and an aperture extending between the second side and the pocket. The pocket and the aperture together define a passage. The motor defines a recess configured to receive the protrusion. The wire is configured to extend through the passage and couple with the motor. The wire has a working length extending between the flat surface and the motor. The mounting bracket and the motor obscure the wire from view such that the working length of the wire is not visible to an observer when the recess of the motor receives the protrusion. The passage extends at least one of proximate and through the protrusion such that the wire extends into the recess when the wire is coupled with the motor and when the recess receives the protrusion.

Yet another exemplary embodiment relates to a fastening device for mounting a motorized roller window shade, the device including a body having a first surface and a second surface and a protrusion fixedly coupled with the body and extending perpendicularly from the second surface. The first surface is configured to bear against a flat surface. The body defines a recess extending inward from the first surface and an aperture extending between the second surface and the recess. The recess and the aperture together define a passage configured to receive a wire therethrough. The protrusion is configured to be received by a motor. The body is configured to obscure the wire such that a working length of the wire extending between the flat surface and the motor is not visible to an observer when the protrusion is received by the motor. The passage extends at least one of proximate and through the protrusion such that the wire extends into the recess when the wire is coupled with the motor and when the recess receives the protrusion.

The invention is capable of other embodiments and of being carried out in various ways. Alternative exemplary embodiments relate to other features and combinations of features as may be recited herein.

BRIEF DESCRIPTION OF THE DRAWINGS

The invention will become more fully understood from the following detailed description, taken in conjunction with the accompanying drawings, wherein like reference numerals refer to like elements.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Figure 1:
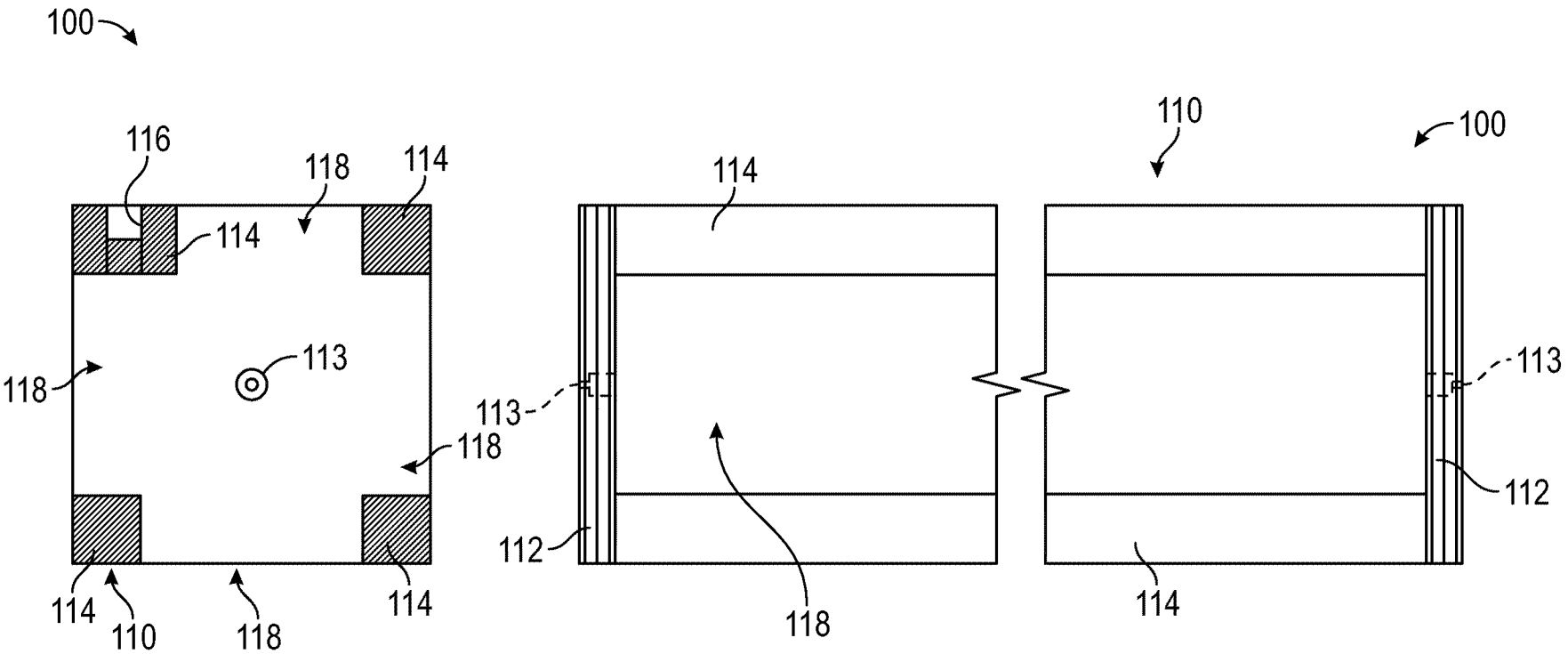
FIG. 1 is a schematic illustration of an exemplary embodiment of a frame of an apparatus for shipping and installing shade tube assemblies.
Figure 3:
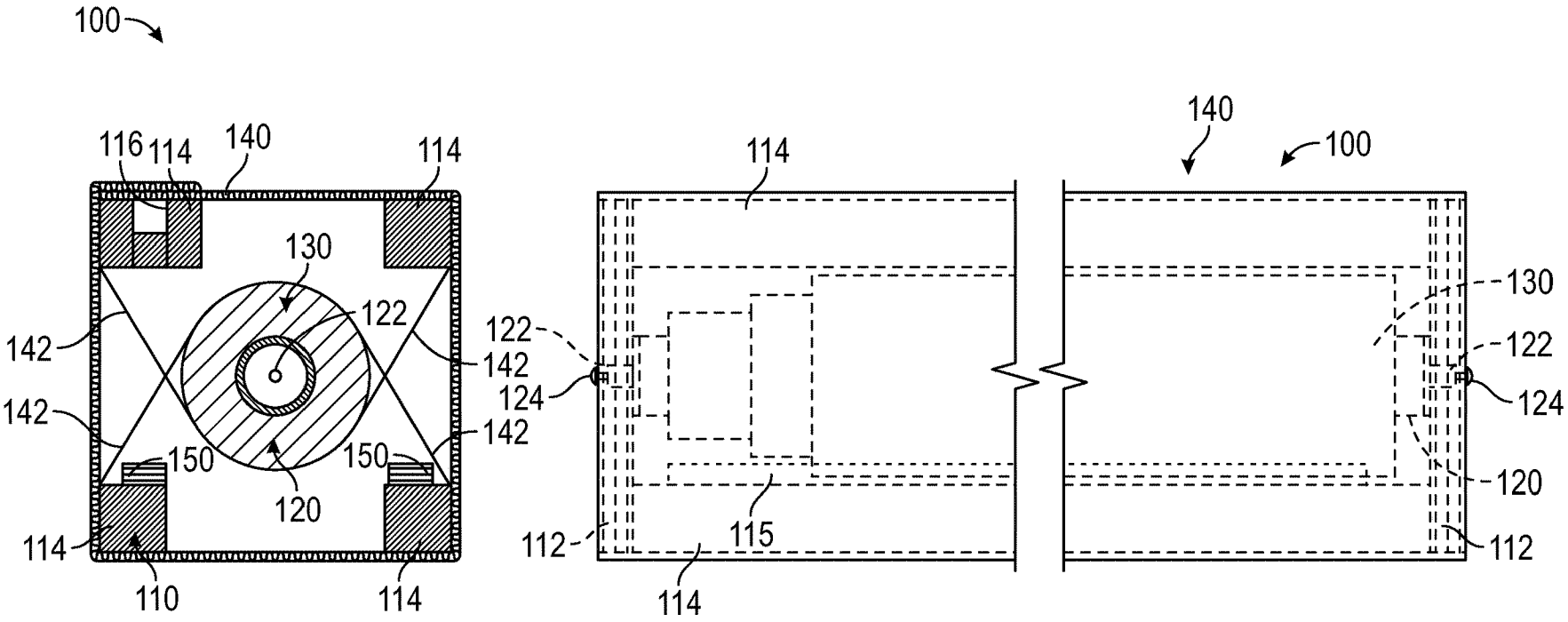
FIG. 3 is a schematic illustration of a shipping configuration for the apparatus for shipping and installing shade tube assemblies of FIGS. 1-2.
Figure 4:
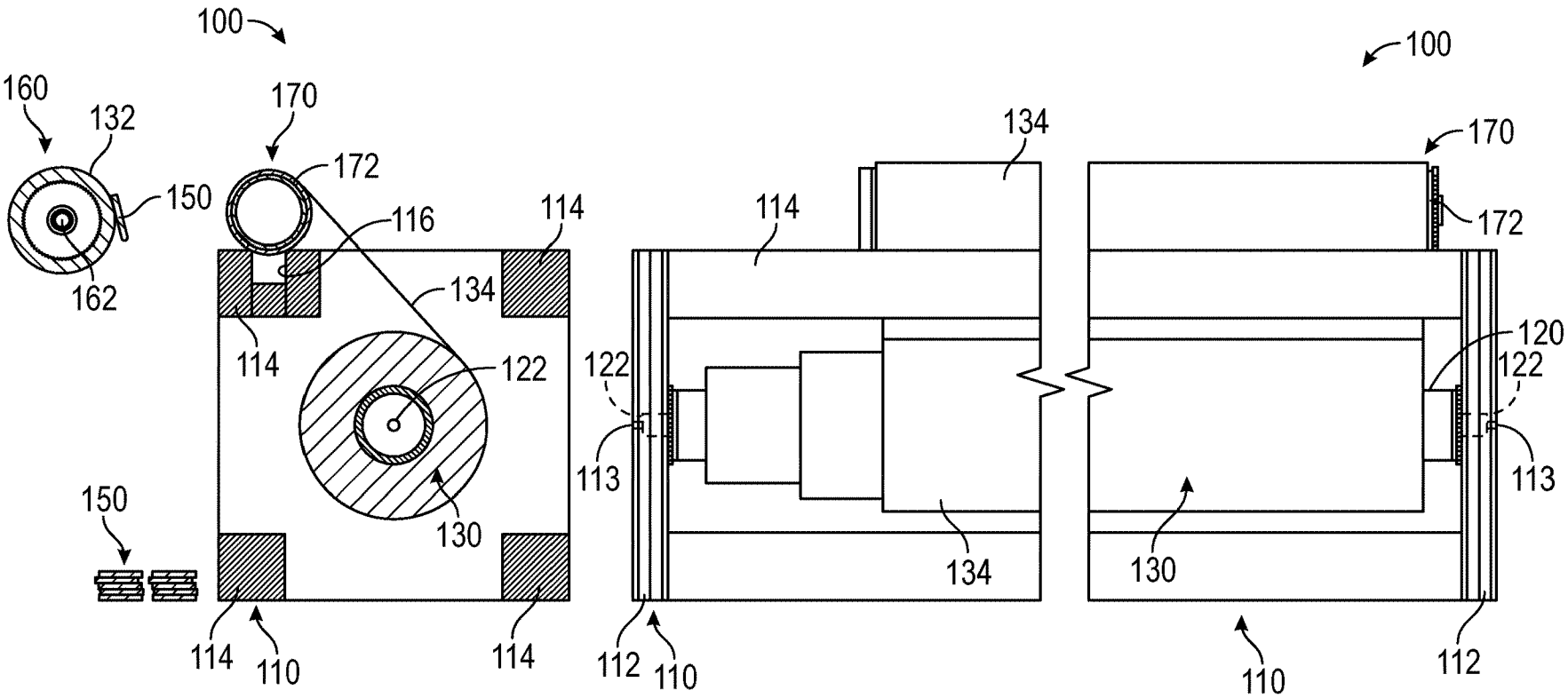
FIG. 4 is a schematic illustration an assembly configuration of the apparatus for shipping and installing shade tube assemblies of FIGS. 1-2.
Figure 5:
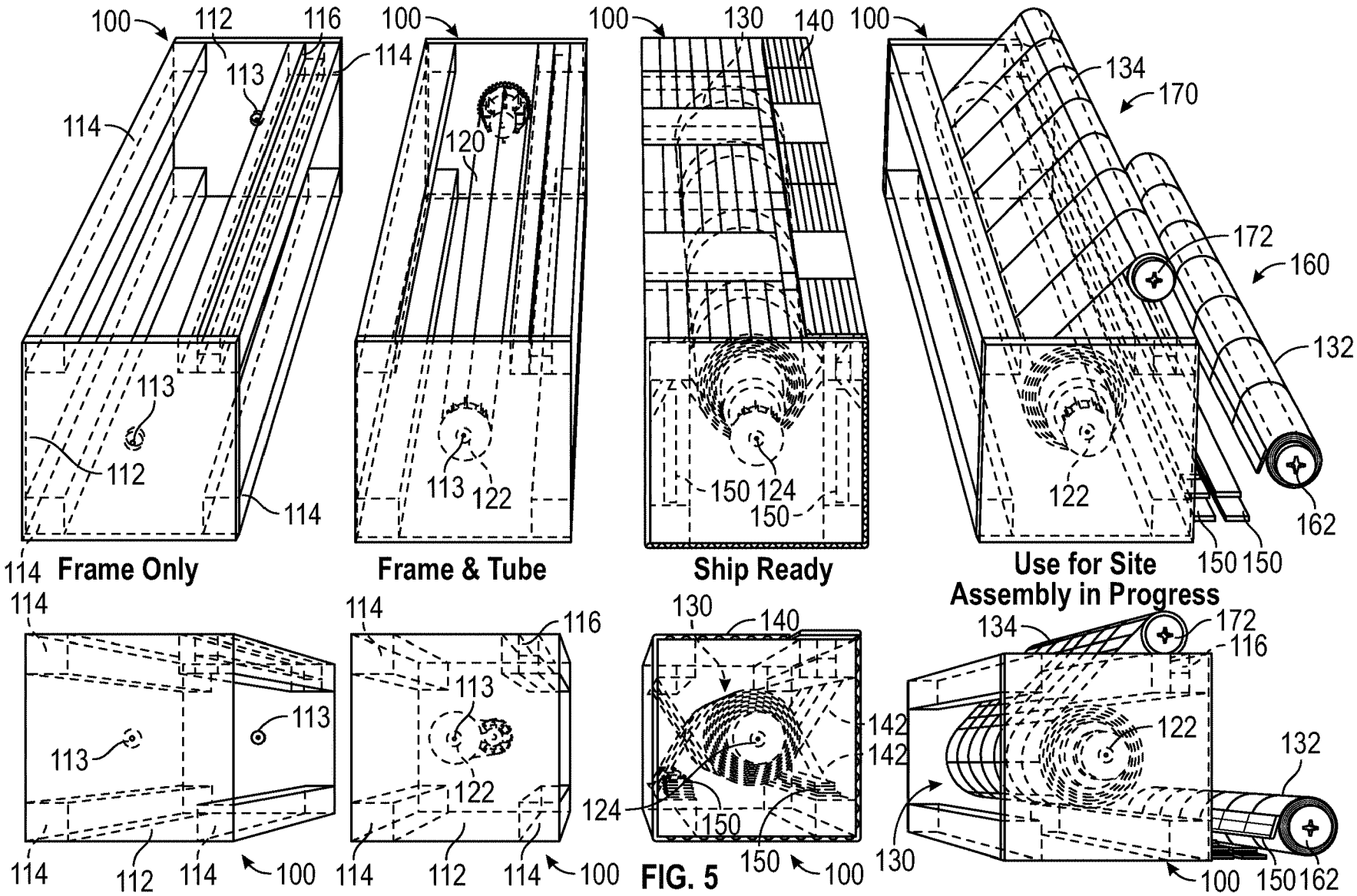
FIG. 5 is a schematic illustration of a left end view of the apparatus for shipping and installing shade tube assemblies as shown in FIGS. 1-4.
Figure 6:
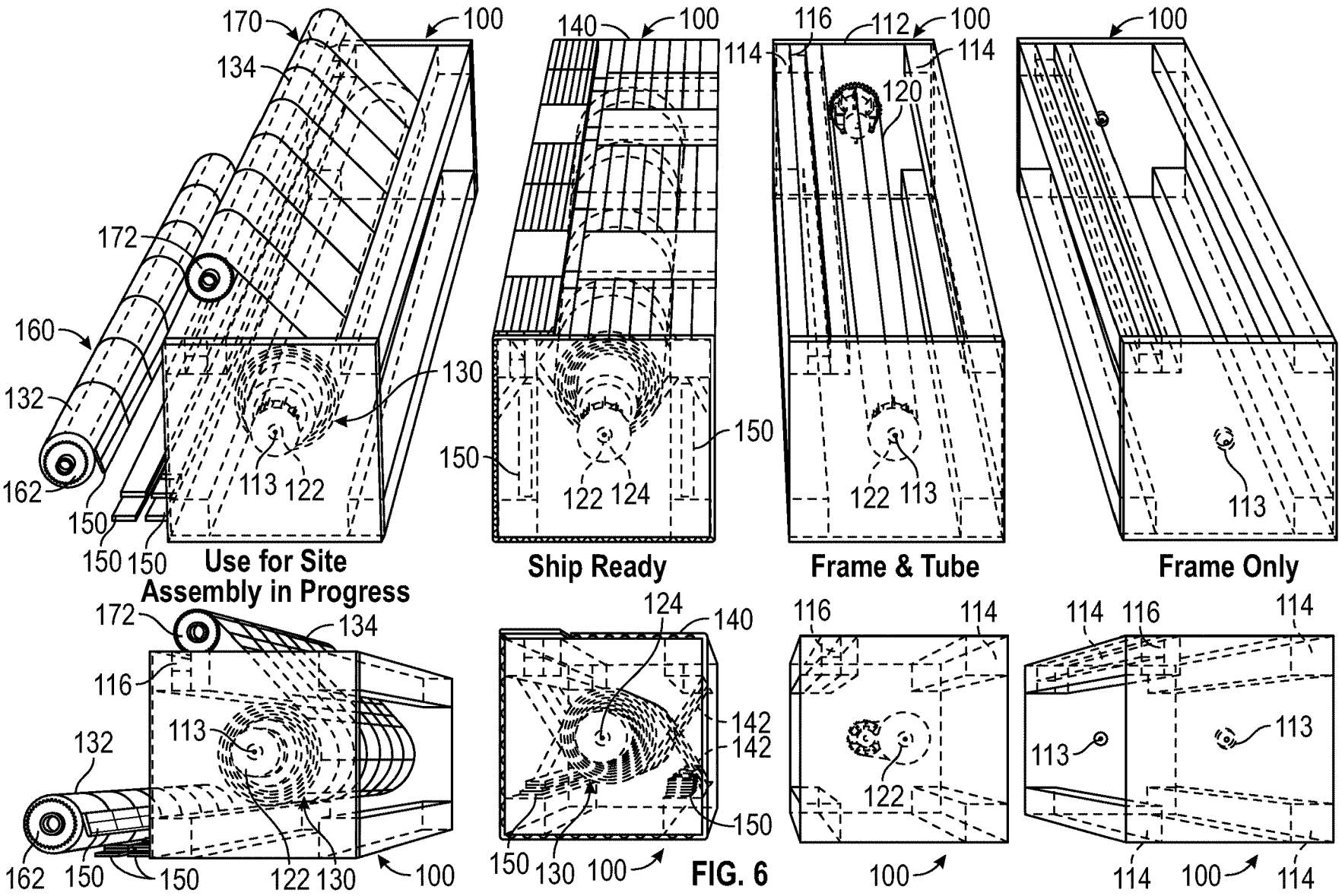
FIG. 6 is a schematic illustration of a right end view of the apparatus for shipping and installing shade tube assemblies as shown in FIGS. 1-4.

According to the exemplary embodiment shown in FIGS. 1-6, an apparatus 100 (e.g., a shipping kit, etc.) is configured to facilitate shipping and installing shade tube assemblies. As shown in FIGS. 1-6, the apparatus 100 includes a frame 110, a shipping tube 120, a plurality of sheets 130 (e.g., shades, fabric, etc.), exterior packaging 140, and a plurality of hem bars 150. As shown in FIGS. 1, 5, and 6, the frame 110 includes a pair of end plates 112 and a plurality of connecting rails 114 extending between the end plates 112. As shown in FIGS. 1, 5, and 6, the end plates 112 define a fitting hole 113. According to an exemplary embodiment, the connecting rails 114 couple the end plates 112 together. In one embodiment, the end plates 112 and the connecting rails 114 are fastened together (e.g., with fasteners such as staples, nails, screws, rivets, etc.). In some embodiments, the end plates 112 and the connecting rails 114 are otherwise coupled together (e.g., with adhesive, welded, etc.). As shown in FIGS. 1, 5, and 6, the connecting rails 114 are spaced apart such that the frame 110 defines a plurality of openings 118 (e.g., to facilitate inserting and removing the shipping tube 120, the plurality of sheets 130, the plurality of hem bars 150, etc. into and from the frame 110, etc.).

The end plates 112 and/or the connecting rails 114 may be manufactured from the same material or different material. In some embodiments, the end plates 112 and/or the connecting rails 114 are manufactured from wood (e.g., ¾" plywood, 2×2's, 1×2's with a spacer, etc.). In some embodiments, the end plates 112 and/or the connecting rails 114 are manufactured from plastic. In some embodiments, the end plates 112 and/or the connecting rails 114 are manufactured from metal. In some embodiments, the end plates 112 and/or the connecting rails 114 are manufactured from another suitable material. As shown in FIGS. 1, 5, and 6, at least one the connecting rails 114 defines a slot or recess 116 that extends at least partially along a longitudinal length thereof.

Figure 2:
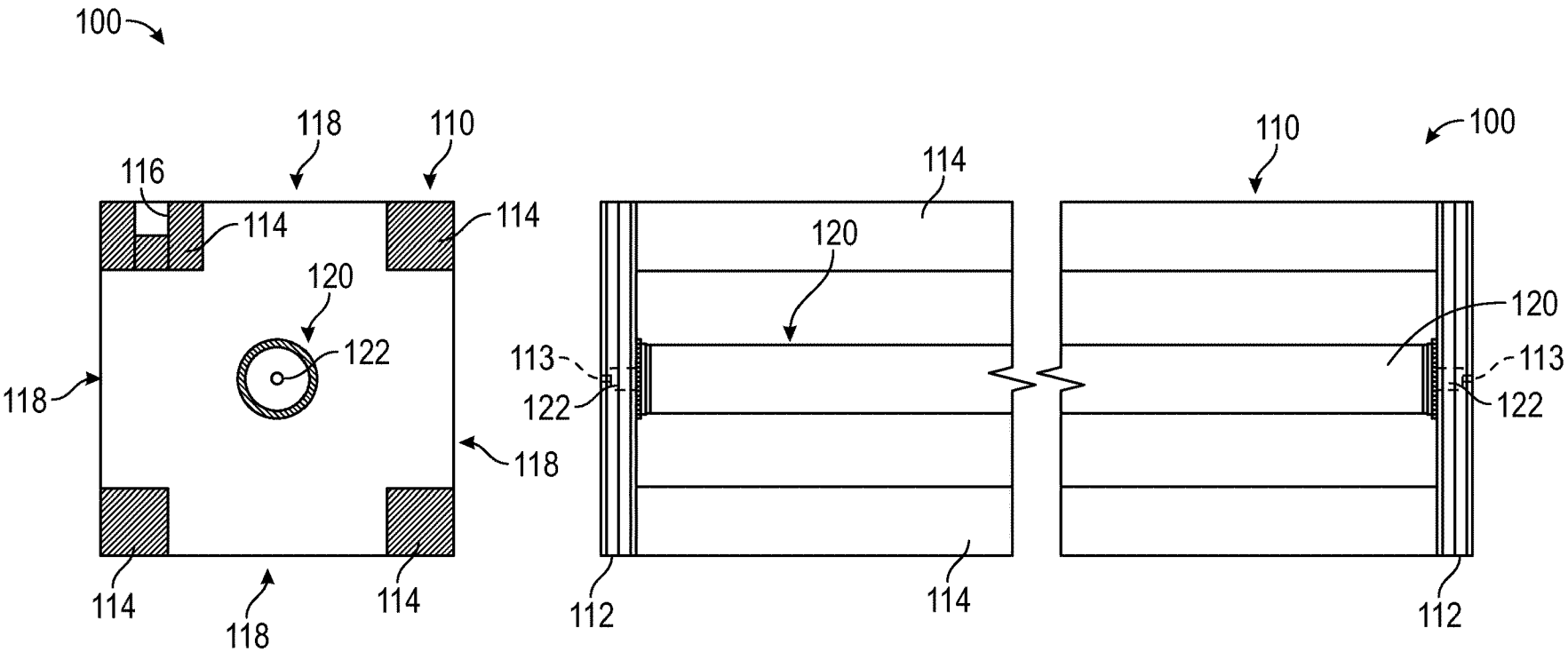
FIG. 2 is a schematic illustration of an exemplary embodiment of a fabric roll installed in the frame of the apparatus for shipping and installing shade tube assemblies of FIG. 1.

As shown in FIGS. 2, 5, and 6, the frame 110 of the apparatus 100 is configured to receive the shipping tube 120. The shipping tube 120 includes retractable fittings 122 positioned on each end thereof. According to an exemplary embodiment, the retractable fittings 122 are configured to be received within the fitting holes 113 defined by the end plates 112 to pivotally couple the shipping tube 120 to the frame 110.

According to the exemplary embodiment shown in FIGS. 3, 5, and 6, the apparatus 100 is arranged in a shipping configuration. As shown in FIGS. 3, 5, and 6, the shipping tube 120 is configured to receive the plurality of sheets 130. By way of example, the plurality of sheets 130 may be pre-cut to final install dimensions. Each of the plurality of sheets 130 may have varying dimensions and shapes. Each of the plurality of sheets 130 may be rolled onto the shipping tube 120 within the frame 110 one-by-one (e.g., sequentially, on top of each other, etc.). After the plurality of sheets 130 are received by the shipping tube 120, the shipping tube 120 may be rotatably secured via fasteners 124 that engage with the retractable fittings 122 to prevent the shipping tube 120 from rotating during shipping and potentially causing the plurality of sheets 130 to unravel. The plurality of sheets 130 may be further secured using one or more straps 142. The straps 142 extend from one connecting rail 114, around the plurality of sheets, and to another connecting rail 114. The straps 142 may be coupled to the connecting rails 114 using staples or other fasteners. Additional straps 142 may be added, some straps 142 connecting to a different combination of connecting rails 114 to facilitate supporting the plurality of sheets 130 in multiple directions. The straps 142 may reduce the load on the shipping tube 120 and prevent the plurality of sheets 130 from unraveling. The plurality of hem bars 150 may be inserted into the frame 110 and/or secured (e.g., tied, zip-tied, taped, stapled etc.) to one or more of the connecting rails 114. The frame 110 may thereafter be covered, enclosed, and/or packaged using the exterior packaging 140. According to an exemplary embodiment, the exterior packaging 140 is and/or includes cardboard. In some embodiments, the exterior packaging 140 additionally or alternatively is and/or includes another material (e.g., wood, etc.). The apparatus 100 may thereafter be ready to be shipped to a desired destination, home, and/or worksite.

According to the exemplary embodiment shown in FIGS. 4-6, the apparatus 100 is arranged in an assembly configuration. As shown in FIGS. 4-6, the apparatus 100 is configured to arrive at the desired destination, home, and/or worksite ready for site assembly. By way of example, upon arrival, the exterior packaging 140 may be removed from the frame 110 to expose the frame 110, the shipping tube 120, the plurality of sheets 130, and the plurality of hem bars 150. The fasteners 124 may also be removed to facilitate free rotation of the shipping tube 120. As shown in FIGS. 4-6, a first sheet 132 of the plurality of sheets 130 may be unraveled from the shipping tube 120 and rolled onto a first shade tube 162 to form a first shade tube assembly 160. One of the plurality of hem bars 150 may thereafter be attached to the free end of the first sheet 132. A second sheet 134 of the plurality of sheets 130 may be unraveled from the shipping tube 120 onto a second shade tube 172 to form a second shade tube assembly 170. The process may be repeated for each additional sheet of the plurality of sheets 130 wrapped around the shipping tube 120. In some embodiments, the shade tubes are shipped within the apparatus 100 with the other components thereof (e.g., the shipping tube 120, the plurality of sheets 130, the hem bars 150, etc.). In some embodiments, the shade tubes are shipped separately from the apparatus 100. As shown in FIGS. 4-6, a shade tube (e.g., the first shade tube 162, the second shade tube 172, etc.) may be positioned (e.g., attached, disposed along, etc.) at least partially within the recess 116 that extends along the longitudinal length of one of the connecting rails 114. The recess 116 may be configured to facilitate holding the shade tube when forming a shade tube assembly and allow for easier unraveling of each of the plurality of sheets 130 from the shipping tube 120 onto each respective shade tube. As shown in FIG. 4, the connecting rail 114 contacts the shade tube assembly such that the weight of the shade tube assembly centers the shade tube assembly within the recess 116.

Figure 7A:
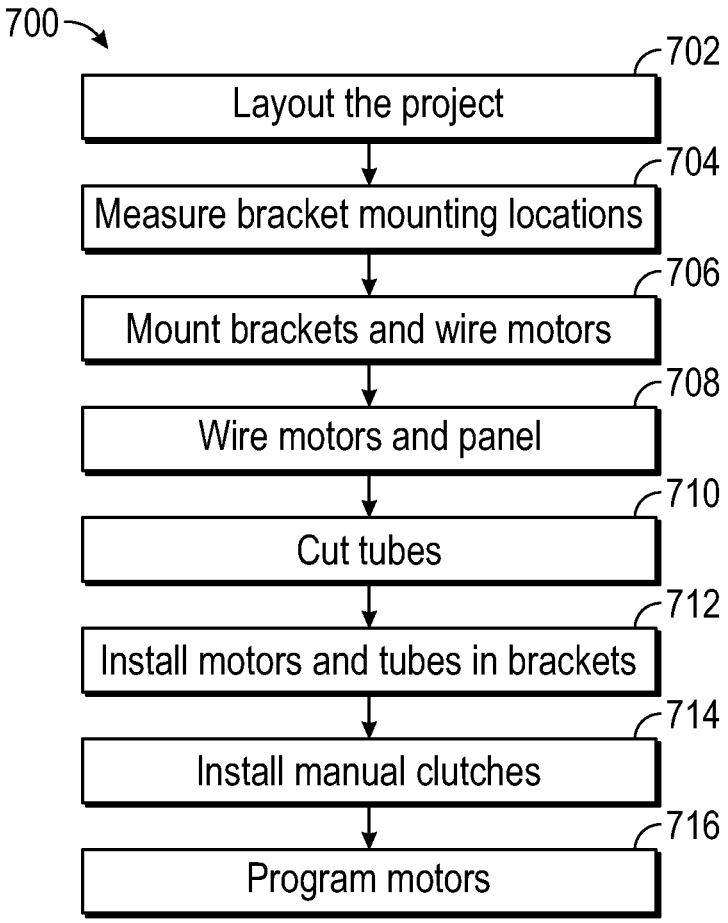
FIG. 7A is a diagram of an exemplary embodiment of a method of initially installing a shade tube assembly according to the inventive concepts disclosed herein.

Referring now to FIG. 7A, a diagram of an exemplary embodiment of a method 700 of initially installing a shade tube assembly is shown according to the inventive concepts disclosed herein. Method 700 may include installing brackets as close to the window as possible and front loading as much of the installation as possible by installing brackets and motors, cutting tubes, wiring, programming, and testing. In some embodiments, all measurements for shade fabric are taken and programming (minus limit setting) is completed as part of method 700, which allows for any issues with wiring, mounting locations, and programming to be discovered and handled before the project is close to being finished.

In some embodiments, an initial installation checklist is used by an installer to ensure that the method 700 is successfully completed. The initial installation checklist, and method 700, may include the following: completing a toolbox inventory to ensure all tools are accounted for and in acceptable operating condition; reviewing the proposal for an accurate count of equipment needs (e.g., tubes, brackets, hardware); ensuring the installer's vehicle is parked in an acceptable and legal location; ensuring that the installer wears booties or removes shoes (unless installation occurs in a rough construction phase); ensuring that all tools and equipment brought onto the jobsite are stored on blankets or drop cloths and never placed on the floor or furniture; verifying all shade locations with the contractor, owner, designer, or architect; ensuring that all brackets are at least substantially inline, vertically straight, and perpendicular with the wall; ensuring that all tubes are cut straight with any rough edges filed smooth; ensuring that the tubes are cut to a proper length (e.g., such that there is a minimal amount of play from bracket to bracket without putting tension against brackets); verifying wire continuity with proper polarity, and if possible running motors; taking pictures with a camera (e.g., a DSLR camera); installing and terminating the power panel with wires, labelling terminations, ensuring that all scrap wiring is removed and that the work area is clean; ensuring that windows, jambs, walls, floors, and ceilings are clean of debris, marks, and dirt; and ensuring that all tools, cleaning supplies, etc. are removed and accounted for.

A step (702) may include laying out the project. The project is laid out so that the project can be as successful as possible. For example, laying out the project may include completing a site walkthrough with the client, designer, architect, or general contractor; locating the power panel mounting area and making sure that there is an outlet installed for the power panel; discussing the power panel mounting location with the client, designer, architect, or general contractor; and tracing and labeling all motor and keypad cables in the power panel.

The shade tube assembly installed using the method 700 includes one or more shade tubes supported by a variety of different mounting brackets. The method 700 is described with respect to a series of mounting brackets shown in FIG. 9, however, the method 700 may be carried out using other types of mounting brackets. The mounting brackets may support one side of one shade tube such that the shade tube can rotate freely (e.g., an idler bracket such as the R1 bracket shown in FIG. 9). Alternatively, the mounting brackets may support one side of one shade while providing a protrusion to key a shade motor (e.g., a bracket such as the R2 motor bracket shown in FIG. 9). For longer spans that require multiple shade tubes (e.g., when covering wide window assemblies), mounting brackets be used that couple to and support one end of two adjacent shade tubes (e.g., coupler brackets such as the bracket R5 shown in FIG. 9).

A step (704) may include measuring mounting bracket mounting locations. For example, in some embodiments, the centers of the R2/R1 brackets shown in FIG. 9 should be positioned 1.75" down and 1.75" off of windows or obstructions, which allows the center of the coupler bracket to be lined up at the same height as the centers of the R2/R1 brackets. The center of the coupler should also be 1.75" from the window.

In another example, for multiple adjoining windows over 8 feet, or for aesthetical purposes, a coupler bracket may be used to couple two adjacent shade tubes. When using the coupler bracket, the coupler is first installed in the top center of the window, or where a break in the shades will be less intrusive to the window design. The process includes making sure that there is adequate space off the window in order to miss the window and door hardware. The end brackets may be installed before the coupler.

This step (704) may further include making sure that the selected shade size is correct for (e.g., compatible with, within the performance limits of) the selected motor and the system. For example, when using D-Series mounting brackets made from delrin, no more than 100 square feet of fabric should be used with each motor. Ten percent of the fabric should be deducted from this limit for each coupler used. In another example, when using R-Series mounting brackets made from aluminum, no more than 150 square feet of fabric should be used with each motor. Ten percent of the fabric should be deducted from this limit for each coupler used.

A step (706) may include mounting brackets and wiring motors. The step (706) includes hiding all wires behind the brackets. Alternatively, in the case of the R4W/R4WD brackets shown in FIG. 9, which provide internal wire passages, the wire may be hidden inside the brackets. The step (706) includes installing the R1 bracket idler on the window jamb; measuring down 1¾" from the top of the window jamb and marking and making a level line at that measurement; and measuring 1¾" out from the window frame and making a center mark on the level line. In one example, if the window jamb is large (e.g., over 3" but under 5"), the step (706) may include centering the bracket in the window jamb rather than positioning the bracket 1¾" out from the window frame.

The step (706) includes putting a small drill bit through a center hole of the idler bracket to the center mark; marking the screw holes of the bracket on the straight line; confirming that the shade location in the jamb will not contact the door or window hardware; making any necessary changes to the location of the bracket; pre-drilling with a pilot bit; and, for example, screwing down the R1 bracket with #6 pan head screws. In some examples, the screws used will be long enough to ensure a solid hold.

The step (706) includes marking a location on the R2 bracket where the wire will go through the bracket prior to wiring the motor; drilling through the R2 bracket; wiring the power and data wires; and placing the R2 bracket on top of the wires such that the wires are hidden behind the bracket. In some examples, a forsner bit may be used to chip away at the jamb if the wire does not have enough play to hide in the wall by carving out enough space for the Dolphin connectors of the wires and then placing the R2 bracket over the Dolphin connectors. The R2 bracket may be installed in a similar way as described with respect to the R1 bracket above, including pre-drilling with pilot bit, then screwing down the R2 bracket with #6 counter sunk head screws and using screws that are long enough to ensure a solid hold.

To facilitate mounting the R5 bracket, the a center mounting brace is used. The center mounting brace includes a hanger bolt having a first threaded end configured to be screwed into wood and a second threaded end that is machine threaded. A sleeve is configured to thread onto the machine threaded end. The sleeve has a set screw hole extending laterally therethrough. The outer portion of the R5 bracket, which is visible after the R5 bracket is mounted, receives the sleeve and has an aperture extending laterally therethrough that corresponds with the set screw hole of the sleeve. To attach the outer portion to the sleeve, a set screw is inserted through the aperture of the outer portion and the set screw hole of the sleeve. The step (706) further includes marking a center line with a square on the top of the window casing from jamb to jamb when installing one or more R5 brackets (extensions) and marking either (a) 1.75" off of the window line or (b) the same distance off as the R2 bracket is mounted. The intersection of these two marks is where the hanger bolt is inserted.

The step (706) includes putting the sleeve on the machine threaded end of the hanger bolt without the set screw and using a Hex key inserted through the set screw hole to tighten the sleeve against the hanger bolt; pre-drilling with a pilot bit, then using the Hex Key to screw in the hanger bolt until the set screw would be positioned just slightly above the set screw hole in R5, this placement forcing the bracket to be pulled tight against the mounting surface; placing the coupler back over the center mounting brace and tighten the set screw to finish mounting. In some embodiments, it is preferred to leave one half inch of the machine threaded side of the hanger bolt out of the mounting surface.

A step (708) may include wiring motors and a power panel. The step (708) includes wiring RTS motors or RS485 motors. When wiring RTS motors a White/Black wire is coupled with a Red (positive) J Wire, and a solid White wire is coupled with a Black (Negative) J Wire.

RS485 motors may require both power and data inputs to function. When wiring RS485 motors, a White/Black power wire is coupled with a Red (positive) J Wire, a Solid White power wire and a Green data wire are coupled with a Black (negative) J Wire; a Black data wire is coupled with a White (RS485A) J Wire; and a Red data wire is coupled with a Colored (RS485B) J Wire. The step 708 further includes wiring the power panel to make sure that the wires are coupled to the appropriate locations (e.g., locations in a Phoenix connector). It will be appreciated that the color of the wires may change based on wire used. Port names and connections for the wires will remain the same, and are as follows: Red to DC24V+; Black to DC24V−; White to RS485A; Colored Wire to RS485B.

A step (710) may include cutting shade tubes. The step (710) may include measuring from bracket to bracket and typing the measurement onto an Order Form in a column labeled "Bracket to Bracket Measurement"; selecting if the measurement includes a Motor/Manual Clutch and cutting the tube to a "Final Tube Measurement" output by a formula on an Excel Sheet. In some embodiments, the measurement is obtained using a laser measurer. The step (710) includes marking a tube cut line with a sharp pencil or pen; ensuring that the tube is parallel to the ground when cutting the tube (e.g., if the tube is tilted, the cutting blade may catch and not cut all the way through the tube); placing the tube into a vice or pipe holder (e.g., the tube vice should be approximately the pressure of a firm handshake and should not be over-tightened or the pressure may deform and damage the tube); using a file to remove burs from inside and around the outside of the tube after cutting the tube; removing all burs from the interior ribs and faces of the tube; and measuring multiple times throughout the process to ensure that no materials are wasted.

A step (712) may include installing motors and tubes in brackets. If using an R5 or other coupler (e.g., the R3 coupler shown in FIG. 9), the step (712) may include locating a drive shade, installing a female Acmeda piece on the opposite side of the drive (e.g., the motor/clutch end) by pushing firmly into the tube ensuring the the female Acmeda piece is fully seated against the end of the tube; turning a clear gear wheel on the female Acmeda piece until it is fully retracted and locked in place; raising the tube up to the coupler bracket; and turning the clear gear wheel to release the female Acmeda piece and lock the shade in place between the brackets. Steps for installing an idler shade include locating the idler end of the shade and installing the male idler Acmeda piece; installing the regular idler Acmeda piece on the opposite end of the tube; inserting the male Acmeda piece into the female Acmeda piece through the R5 coupler; turning the gear on the idler Acmeda piece until it is fully retracted and locked in place; raising the tube up to the R1 bracket and turning the gear on the idler Acmeda piece to release it and lock the shade in place between the brackets.

If a coupler is not used (e.g., if male/female Acmedas are not needed), the step (712) may include mounting the motor end of the shade first by aligning a cross or "plus" sign shape in the motor (e.g., as shown in the recess 1036 of FIG. 11A) with the R2 or R4 bracket and gently applying pressure seating it completely against the end; installing an idler Acmeda piece into the tube and turning the clear gear to retract and lock the idler Acmeda piece into place; raising the tube up to the R1 bracket; turning the gear to release the wheel and lock the shade into place between brackets; and making sure there is at least a 1/16" play in the left to right direction to allow for adjustment and to make sure the shade is not too tight in the casing once the shade is fitted into the brackets. For example, the shade should be able to shift horizontally between the brackets 1/16" or the tube is too long. The step (712) may include ensuring that the shade is level and if the shade is not level, adjusting the brackets to make the shade level. In some embodiments, the R1/D1 bracket allows for minor leveling adjustments by slightly loosening the screws to allow the screws to travel along slots defined in the bracket and sliding the bracket up or down. The step (712) may include checking the measurement of the tube length and the window height and notating these measurements on the order form as well as writing the length and shade number on tape on the tube to ensure that there are no mistakes; and testing the motors to identify problems with wiring or anything else.

A step (714) may include installing manual clutches that allow a user to raise and lower the shade by pulling on a chain. Such manual clutches may include a spring assist to assist a user in raising a heavy shade. The manual clutch may take the place of the motor described above. The step (714) includes removing a screw from inside a manual clutch and removing a square part from the end; sliding a sleeve off of a spring shaft; lining up a stainless steel chain with indents on the clutch; feeding the chain through a chain cover on the sleeve; replacing the sleeve onto the spring shaft and managing the chain to stay inside indents; inserting the screw back into the hole in the clutch; placing the square part back in place and tightening the screw completely; inserting the Manual Clutch Insert Piece into the Manual Clutch; and following the above instructions for installing tubes.

The step (714) may include customizing the chain to the window length. As the vertical lengths of windows change between different applications, the length of the chain may be adjusted to prevent the chain from hanging onto the floor. Customizing the chain to the window length may include using wire cutters to cut the chain to the correct length for the window opening; using chain crimpers to open two balls at the end of the chain; holding one of the open balls in crimper and feeding the connector on the opposite end into the opening; and squeezing the crimpers to close the chain link once the connector is in the open ball.

The step (714) may include installing a safety device. Installing the safety device may include mounting an R2/D2 bracket or a R4/D4 bracket where the manual chains end and placing the safety device over the manual chain and on the bracket and then tightening a set screw.

A step (716) may include programing motors. For example, in some embodiments, one or more motors may be an RTS motor or an RS485 motor. When programming an RTS motor, inserting a paperclip or thumbtack into the yellow port should cause the shade to move, thereby indicating it is wired correctly. Steps for programming an RS485 motor may include filling out a Motor IDs spreadsheet with all motor locations and Node IDs (e.g., Node IDs may be located on the motor); mapping out the groups intended to be used on the Motor ID spreadsheet; opening a Somfy SDN Motor Configurator program and connecting a USB to DB9 cable to the computer and an RS232 to an RS485 converter; using the Node IDs, connecting to each motor and adding groups to each motor (E.g., Group 1 is 100000, Group 2 is 200000, etc.); in a Limits section; adding fake up and down limits to each motor for testing; and inserting a Group ID for each room and testing the Up and Down limits for each group. If all motors in each group move, the wiring is correct.

Figure 7B:
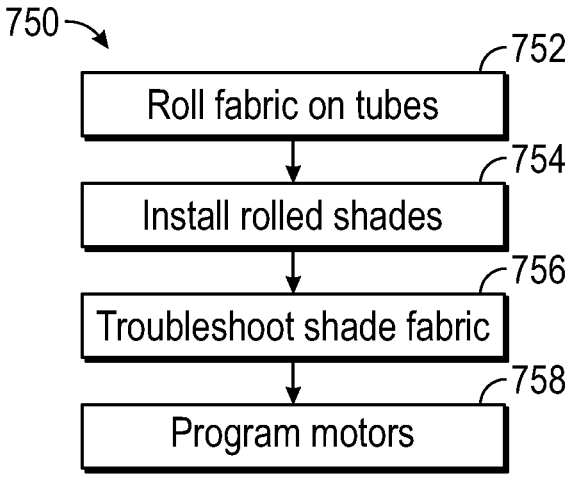
FIG. 7B is a diagram of an exemplary embodiment of a method of finishing the installation of a shade tube assembly.

Referring to FIG. 7B, a diagram of an exemplary embodiment of a method 750 of finishing the installation of a shade tube assembly is shown according to the inventive concepts disclosed herein. Method 750 may include installing all shade fabric, setting limits, fixing walking, and finalizing programming with the client. Method 750 includes finalizing the installation and handing the project off to the client for the client's use.

In some embodiments, a final installation checklist is used by an installer to ensure that the method 750 is successfully completed. The final installation checklist, and method 750, may include the following: completing toolbox inventory and accounting for all tools and ensuring all tools are in acceptable operating condition; verifying that there has been no damage to the fabric shipping box/fabric; ensuring installer's vehicle is parked in an acceptable and legal location; the installer wears booties or removes shoes (unless installation occurs in a rough construction phase); all tools and equipment brought on jobsite are stored on blankets or drop cloths and never placed on the floor or furniture; wearing white cotton gloves any time the installer will potentially contact fabric; ensuring all brackets are at least substantially inline, vertically straight, and perpendicular with the wall; setting all shade limits evenly (e.g., shades in line fully up and down); ensuring that tubes are cut to proper length (e.g., a minimal amount of play from bracket to bracket and not putting tension against brackets); ensuring that there are no stains, tears, or wrinkles in the fabric; taking pictures with a camera (e.g., a DSLR camera); adjusting all shades for walking/telescoping; ensuring all programming has been completed and tested; installing safety mechanisms on all manual shades; ensuring windows, jambs, walls, floors, and ceilings are clean of debris, marks, and dirt; and ensuring all tools, cleaning supplies, etc. are removed and accounted for.

A step (752) may include rolling fabric on tubes. Rolling fabric on the tubes may include shipping shades from a production facility rolled one on top of the other in the apparatus 100 for shipping and installing shade tube assemblies (e.g., as shown in FIG. 3); locating a packing list to verify the order and that the correct shades are rolled in the apparatus 100 for shipping and installing shade tube assemblies. In some embodiments, the shades are rolled largest (e.g., widest) on bottom (i.e., closest to the shipping tube) and smallest on top. The step (752) includes removing the shade tubes from the mounting brackets and cleaning the tubes (e.g., with Clorox wipes and Microfiber cloths); applying double-sided tape to the lower lip of the tube; and carefully adhering the shade to the tube by pressing the shade up against the upper lip of the tube, being careful not to pull the fabric too hard while taping it; and rolling the fabric onto the tube and inserting the hem bar into the fabric. The step (752) may include wearing white gloves when handling the fabric of the shades to prevent oil from the installer's hands from getting the fabric dirty and requiring time to clean at the end of the installation. The step (752) may include cleaning the shade by rubbing the shade with a cleaning tool (e.g., a dry Mr. Clean Magic Eraser).

A step (754) may include installing rolled shades. The step (754) includes following the installation instructions presented above beginning with the motor end. When decoupling a shade from the motor, the step (754) includes wrapping the shade with tape to prevent the shade from unrolling and causing damage to the sill, shade, and anything nearby.

A step (756) may include troubleshooting shade fabric. Troubleshooting the shade fabric includes troubleshooting shade walking (e.g., lateral movement of the shade fabric relative to the shade tube) and shade speed. Shade walking is indicated by an imperfect roll (e.g., a roll where each consecutive wrap of fabric is not aligned) that is created at its upper limit. Problems with shade speed are indicated by one shade moving slower than another shade when being extended or retracted.

Troubleshooting shade walking includes bringing the shade to the upper limit and flipping the shade over the tube twice; running the shade to the lower limit (being careful not to damage the fabric); adding a small square piece of tape to the side protruding from the tube; and running the shade up and taking note of how much the walking improved. If the issue is still not fixed, the process includes adding another piece of tape to the side protruding from the tube.

Troubleshooting shade speed includes lowering the shades to their bottom limit; making sure that the shades are even at the bottom limit; running the shades to the upper limit and flipping the slower shade over twice if the shades line up at the bottom limit; running the shades to their lower limit again and adding a single unbroken piece of tape across the length of the shade; running the shades back up; and again testing the speed of both shades. If the issue is still not fixed, the process may be repeated. In some embodiments, if the issue cannot be fixed by tape, the process includes checking the length of both shades to make sure they are equal, and if one shade is significantly longer than the other shade, the process includes using a razor to cut off the excess shade.

Figure 11A:
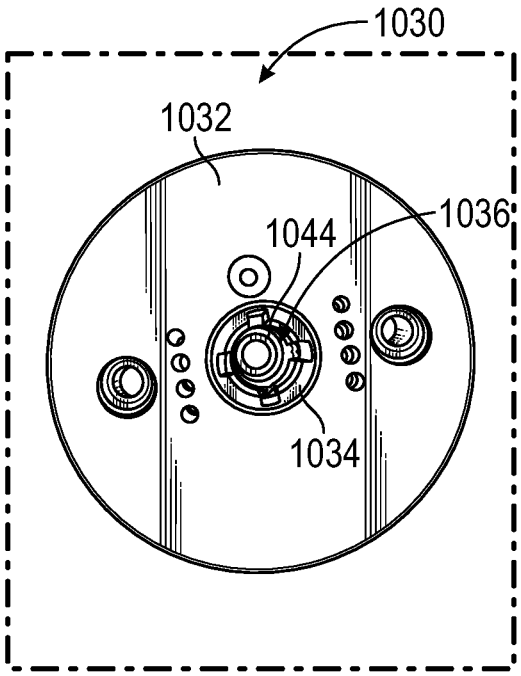
FIG. 11A is a schematic illustration of a hidden wire mounting bracket according to an exemplary embodiment.
Figure 11B:
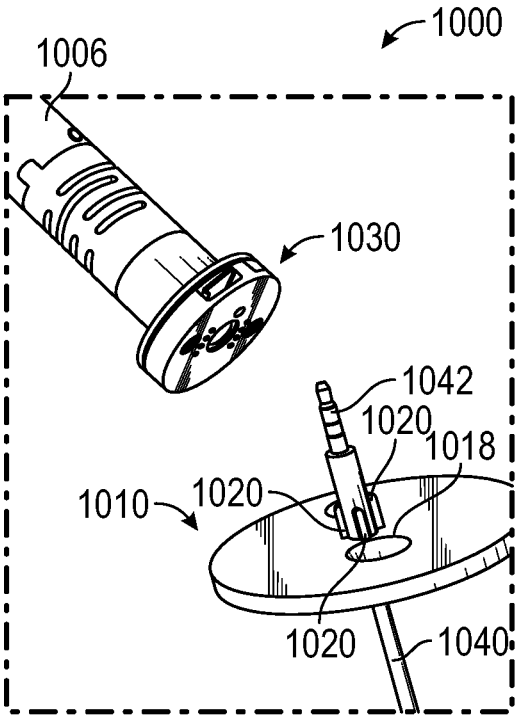
FIG. 11B is another schematic illustration of the hidden wire mounting bracket of FIG. 11A.

A step (758) may include programing motors (e.g., the motor 1030 shown in FIG. 11A). Programming motors includes setting limits, adding motors to different groups, adjusting limits without pressing the program button on the motor, and programming the URTSII.

Setting limits includes using a thumbtack or paperclip to press and hold the program button on the motor (e.g., the white port) and waiting for the shade to jog once to indicate the motor is in programming mode; selecting a channel on a remote/keypad to program and pressing the program button on a remote/keypad until the shade jogs; checking the motor direction by pressing DOWN on the remote/keypad and waiting for the shade to go up and holding a MY/STOP button until the shade jogs indicating that the shade is moving in the correct direction; using an UP arrow to move the shade to the desired top limit and once there pressing the DOWN and MY/STOP buttons simultaneously to cause the shade to begin moving down; using the DOWN arrow to move the shade to the desired bottom limit and once there pressing the UP and MY/STOP buttons simultaneously to cause the shade to begin moving to the upper limit set previously and stopping when it gets there; holding the MY/STOP button once the shade has stopped at its upper limit and until the shade jogs to exit the programming mode and allowing the shade to function as programmed.

Adding motors to different groups includes pressing the program button on the motor with a paperclip or thumbtack until it jogs once; selecting the channel to add the shade to on the remote/keypad; and pressing the program button on the remote/keypad until the shade jogs thereby adding the shade and its limits to the new channel and remaining on the old channel. In one example, after programming all motors in a room to Group 1, it may be desirable to add a channel for a door, a channel for the left side of the room, and a channel for the right side of the room. Instead of reprogramming all limits again, the above steps may be followed to program a channel for the door, a channel for the left side of the room, and a channel for the right side of the room.

Adjusting limits without pressing the program button on the motor includes selecting the channel on which to change limits; holding the UP and DOWN buttons on the remote/keypad simultaneously until all shades jog; and adjusting the limit using the arrows and pressing and holding the MY/STOP button to confirm the new placement. When adjusting the upper limit the shade group is first ran up, and when adjusting the lower limit all shades in the group are ran down. In one example, if only a minor adjustment to the shade upper and lower limits is desired, the processes described in this step (758) can be used to adjust the limits quickly.

Programming the URTSII includes plugging in the URTSII after setting all limits in the shades with a remote/keypad; holding the programming button on the motor to add to the URTSII; selecting the channel to program on the back of the URTSII (e.g., Channels 1-9, A-F are channels 10-15, 0 is Channel 16); holding the Programming Button (e.g., 1 second max); and waiting for the shade to jog thereby indicating that the URTSII has memorized the shade motor programming.

Programing motors may include programming an RS485 motor. Programming an RS485 motor includes grouping motors, controlling a single motor and hidden node IDs, setting limits, programming keypads, programming shade buttons, programming up and down buttons, and adding strings.

Grouping motors includes filling out a Motor IDs spreadsheet with all motor locations and Node IDs; mapping out the groups for use on the Motor ID spreadsheet; opening a Somfy SDN Motor Configurator program and connecting a USB to DB9 cable to the computer and RS232 to RS485 converter; using the Node IDs to connect to each motor and to add the groups to each motor (e.g., Group 1 is 100000, Group 2 is 200000, etc.); adding fake up and down limits to each motor for testing in the Limits Section; and inserting the Group ID for each room and test the Up and Down limits for each group. After completing the grouping motors step, if all motors in each group move, the wiring is correct.

Controlling a single motor and hidden node IDs includes recording the Hidden Node IDs from the ILT program for each motor to control individually by typing the Node ID from the motor and clicking Single Motor to cause a box to appear showing the Hidden ID; assigning the Hidden Node ID to a motor in the SystemBuilder program by clicking Equipment on the left pane, then double-clicking Shades and selecting Properties; and entering the Hidden Node ID in the format "\x12\x34\x56."

Setting limits includes wiring the panel using a USB to DB9 cable to the Serial Converter and from the Serial converter using a 5-port RS232 adapter to a Phoenix connector wired as per the following: T+ on 5-port to RS485-A on board; T− on 5-port to RS485-B on board; GRND on 5-port to 24 VDC− on board. Setting limits further includes opening the Somfy SDN Configurator and connecting to the USB to DB9 port via the drop down box in the top left corner; entering the Node ID found on the motor and clicking the circle that says "Single"; checking the "Limit Adjust" box on the right hand side to begin setting limits; clicking "Wink Motor" which should cause it to jog; typing "20" into the down box and clicking "Down(Pulses)" and, if the shade moves up, clicking "Reverse Direction"; setting limits using numbers 10-1000 to move the shade; clicking "Set Down at Current" once the shade reaches the desired position click; doing the reverse to set the Up Limit; testing the limits by clicking "Up Limit" and "Down Limit" on the left side of the screen once both limits are set. If a limit is being set and the shade is moving very quickly the shade may be stopped and the motor reset. In some embodiments, when setting an up or down limit, the last input is set as a corresponding command. For example, if the shade moves too low by 50, sending an Up Pulse of 50 and setting Down at Current will not work and instead the shade should be run up 60 and down 10 to get to the desired bottom limit. In some embodiments, to use a pulse number smaller than 10, the setting should be moved in the opposite direction by a number slightly larger (e.g., to go down 5, first move up 10 and then down 15).

Programming keypads includes adding a Keypad by first selecting "Interfaces" on the left pane; clicking "Equipment" and on the right pane locate the model keypad to be added; and double clicking the keypad to add the keypad. Buttons may be named by double clicking the button to be renamed. A variable may be created by clicking the "Programming" tab; selecting "Variable Editor" located at the top of the middle pane; using the add button create a variable; and renaming the variables for each button.

Programming shade buttons includes clicking the shade button to program under the "Programming" tab; using the drop down box next to the button type to make it a "Timeout"; selecting the "Press" Tab and double-clicking to add a step in the programming screen; selecting "Variables" and choosing the variable created for the button with its "ON" value; selecting the variable created for the button with its "OFF" value for the "Timeout"; and repeating these steps for all named buttons.

Programming up and down buttons includes selecting the "Down" arrow and double-clicking to add a step; selecting the "Conditionals" bubble; selecting "Variables" and choosing the variable for the first named button created earlier; from the dropdown box, choosing the "ON" value and clicking "Add"; making sure the circle is selected for "Join with AND" clicking "Apply". Once back to the programming screen, the display will indicate that a new programming was added. Programming up and down buttons further includes adding a step after "THEN" to move the desired Group or Motor UP and repeating for all names buttons for "UP" and "DOWN". For example, in one embodiment, the correct programming should read as follows: IF [Variable=Value ON] Then [Equipment Room,Shades→GroupX_three_button_up; Else; End IF.

Adding strings includes, under the Equipment tab, double-clicking on "From AV for Control"; clicking on "Properties"; and scrolling down to where receive strings begin and adjusting the strings accordingly.

To integrate with RS485 motors, the step (758) may include configuring settings to integrate with motors made by Crestron, Lutron, Savant, and Control4. Settings to configure may include baud rate, dta bite, stop bits, parity, hardware handshaking, software handshaking, and string commands configured to follow a particular pattern. For example, the particular pattern may be (GroupNumber)+(U for Up, S for Stop, D for Down) (e.g., Group 1 up could be "1U", Group 2 down could be "2D", etc.).

To integrate with a Lutron system, an integrator may procure an RJ45 Serial converter (e.g., NWK-E device); using a straight through serial cable to Port 2 of J Geiger processor; and configuring a string notation as follows: "[GroupNumber][U for Up, S for Stop, D for Down][CarriageReturn]. To integrate with a Savant system, the integrator may use a Null Modem Serial Cable from Savant processor to Port 2 of J Geiger processor. To integrate with a Control4 system, the integrator may use a Null Modem Serial Cable from Savant processor to Port 2 of J Geiger processor; create a Driver for RS232 communication; and use the following string notation: [GroupNumber][U for Up, S for Stop, D for Down].

Figure 8:
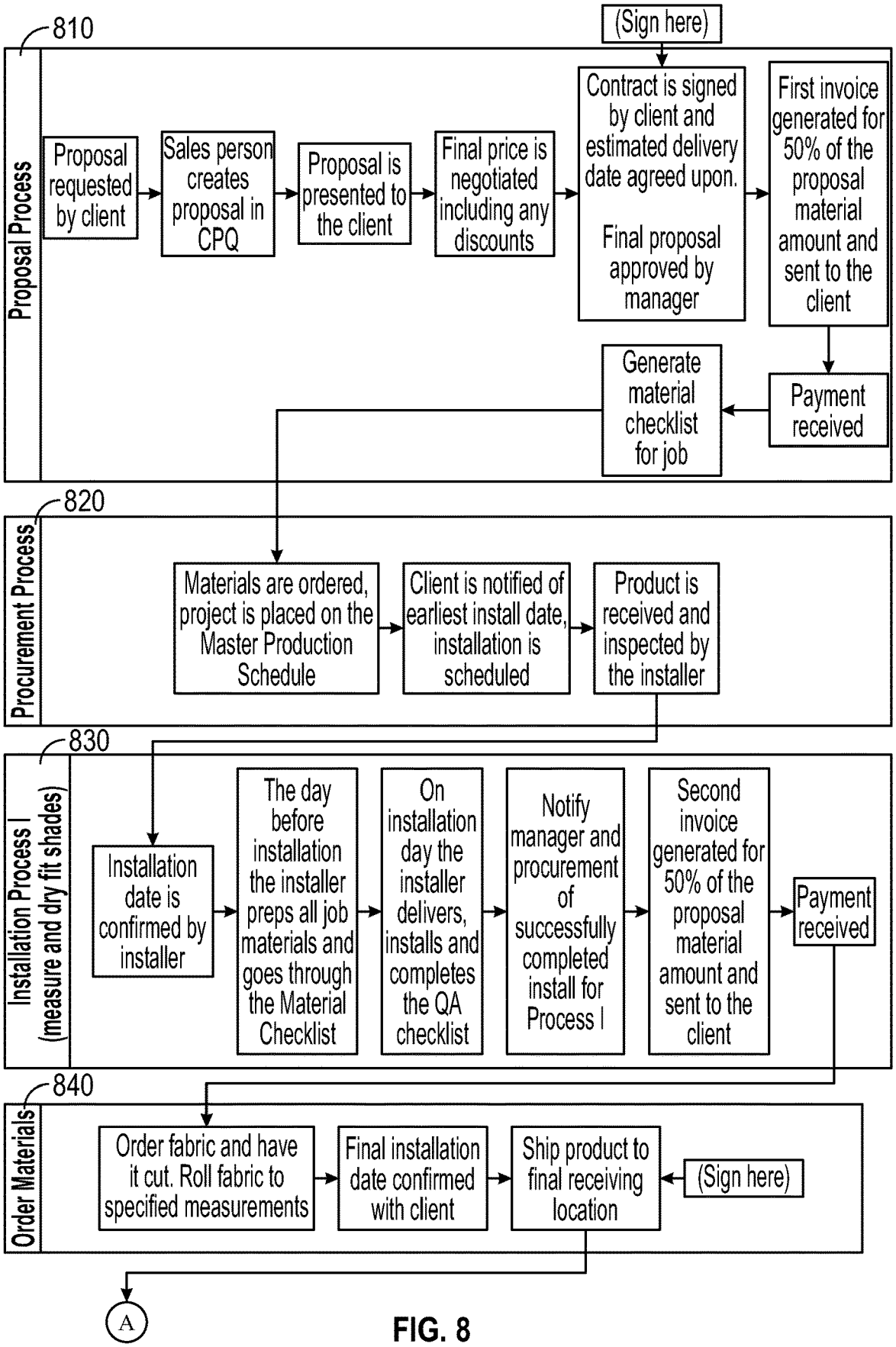
FIG. 8 is a diagram of an exemplary embodiment of a method for proposing a shade tube assembly installation project, procuring materials for the project, initially installing the project, ordering materials for the project, finishing installation of the project, and providing customer service for the project.
Figure 8:
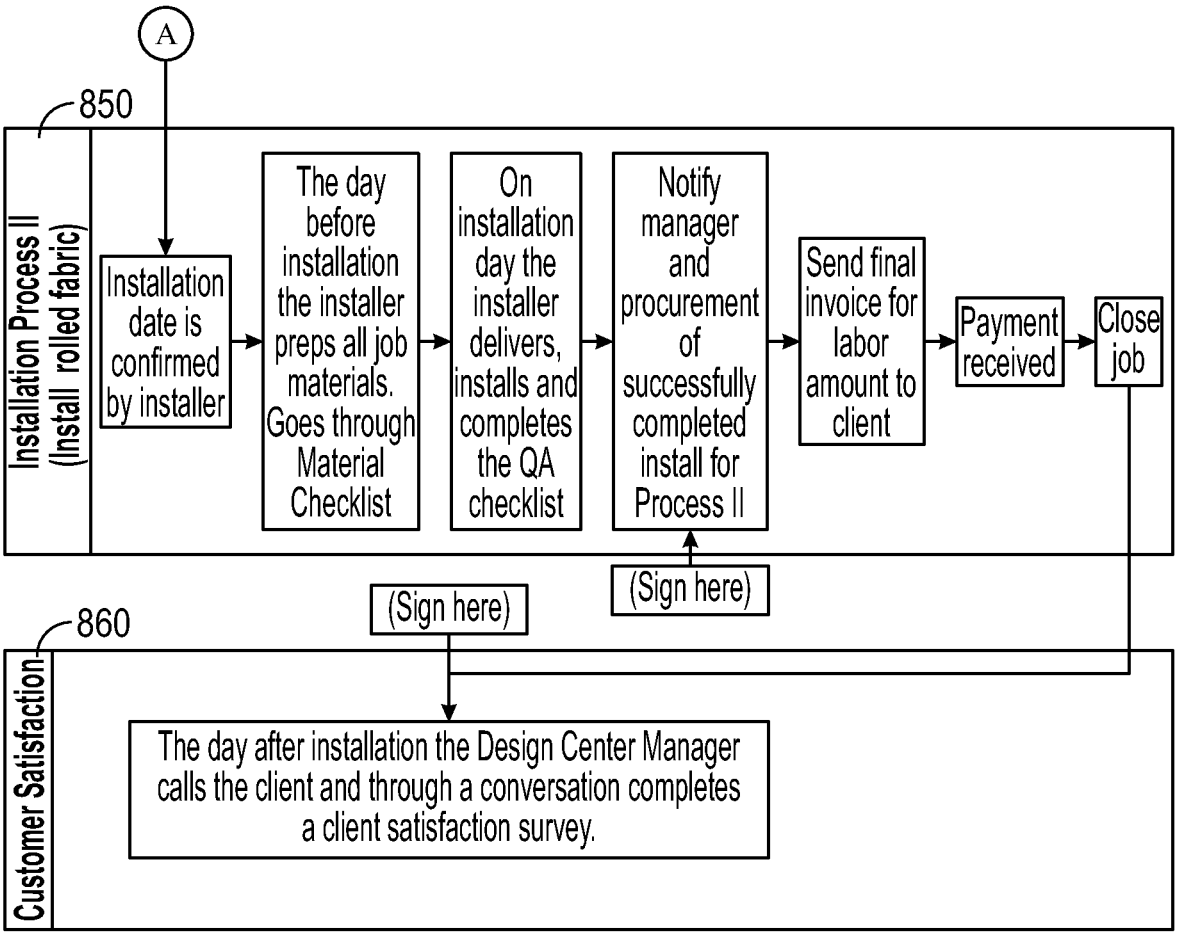

Referring now to FIG. 8, a diagram of an exemplary embodiment of a method for proposing a shade tube assembly installation project 810, procuring materials for the project 820, initially installing the project 830, ordering materials for the project 840, finishing installation of the project 850, and providing customer service for the project 860 is shown.

A variety of brackets for mounting shades are shown in U.S. Pat. No. 9,237,821, which is incorporated herein by reference in its entirety.

Figure 9:
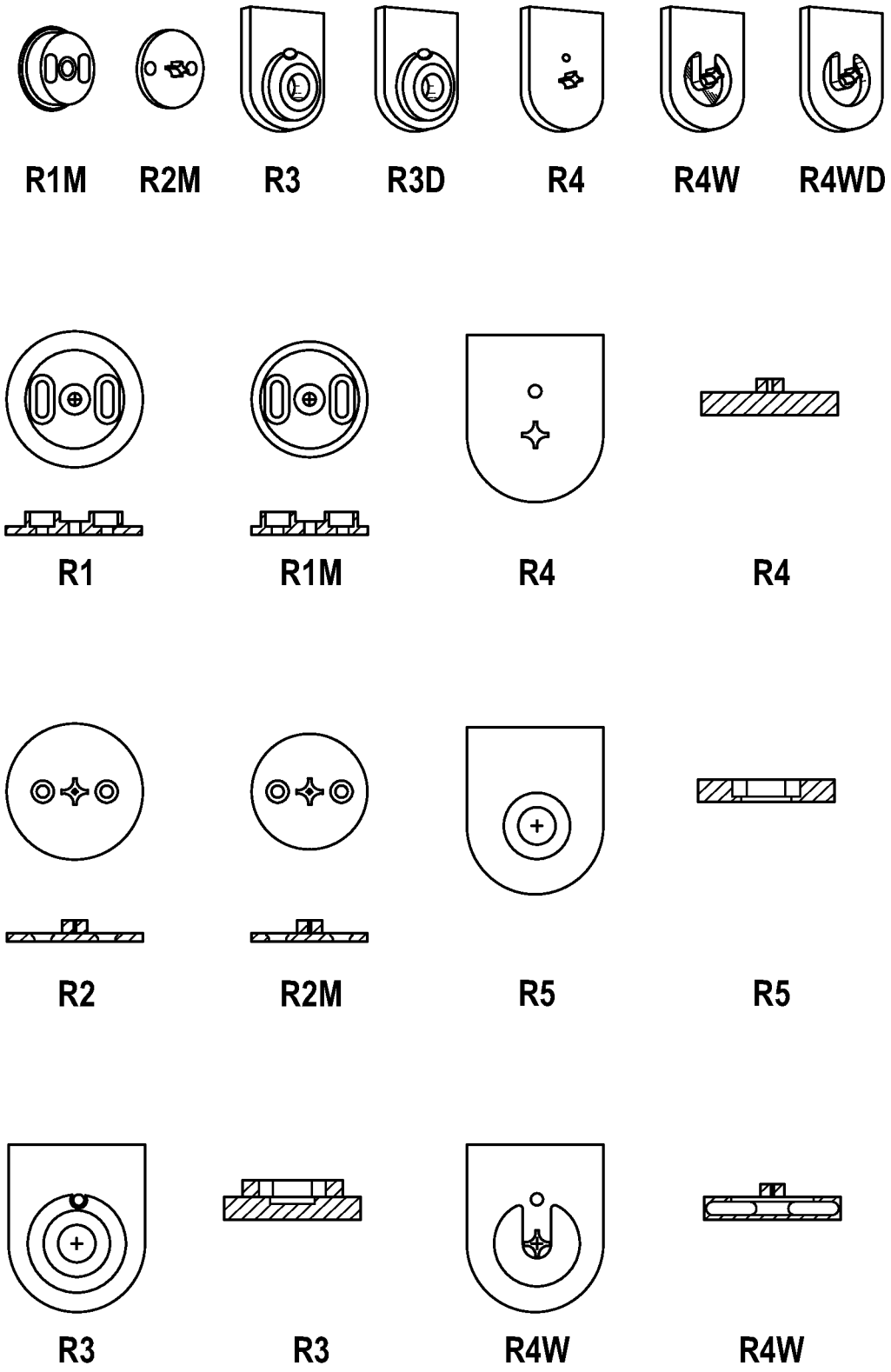
FIG. 9 is a schematic illustration of exemplary brackets for mounting a shade tube assembly according to the methods of FIGS. 7A-8.

Referring now to FIG. 9, a schematic illustration of brackets for mounting a shade tube assembly according to the methods of FIGS. 7A-8 is shown. Any of the brackets shown in FIG. 9 may be used to implement the methods of FIGS. 7A-8. A listing of the brackets and descriptions of each bracket shown in FIG. 9 is provided as follows: R1/D1—Used to end inside mounted shades with an idler; R2/D2—Motor bracket for inside mounted shades; R3/D3—Used to end outside mounted shades with a female Acmeda; R4W/D4W—Motor bracket for outside mounted shades (There is a R4/D4 model which does not allow for wiring and is used for manual shades); R5/D5—Used as a coupler for inside and outside mounted shades; R4DW—Used as a coupler on long shade runs as it is configured to connect to a motor on each side; R3D—Used as a coupler when utilizing an R4WD as it keeps the shade breaks symmetrical; R/D Series Safety device—attaches to an R2/D2 OR R4/D4 to safely secure the chain used for manual clutches; R1M—Same use as R1, only with a smaller 2" diameter; R2M—Same use as R2, only with a smaller 2" diameter. The D-Series brackets (e.g., the D1 bracket) are similar to the R-Series brackets (e.g., the R1 bracket) except in the material used to construct the brackets.

In implementing the methods of FIGS. 7A-8, various types of motors, acmeda pieces, panels, controllers, accessories, wire, and computer programs may be used.

For example, exemplary motors and brief descriptions of the same include the following: RTS Motor—uses radio frequency to communicate with motors; RS485 Motor—uses hard wired RS485 to communicate with motors; Manual Clutch—uses a chain to move shade up and down; Spring Assist—primarily used in manual shade installations when the shade is too heavy to be comfortably lifted with a chain (usually when multiple shades are coupled using coupler brackets). It will be appreciated that the preceding list of motors are not exhaustive and that it will be apparent to one of ordinary skill in the art that other motor types may be used.

For example, exemplary acmeda pieces and brief descriptions of the same include the following: Male—used to couple shades around a R5/D5 bracket; Female—used to couple shades around a R5/D5 or R3D bracket. Also ends outside mounted shades in R3/D3 brackets; Idler—used to end shades in R1/D1 brackets. It will be appreciated that the preceding list of acmeda pieces are not exhaustive and that it will be apparent to one of ordinary skill in the art that other acmeda piece types may be used.

For example, exemplary power panels and brief descriptions of the same include the following: D10—Used for jobs with 10 of fewer RTS motors. Measures 14" (W)×14" (H); D10C—Used for jobs with 10 or fewer RS485 motors. Measures 14" (W)×21" (H); D20—Used for jobs with 20 or fewer RTS motors. Measures 14" (W)×21" (H); D20C—Used for jobs with 20 or fewer RS485 motors. Measures (14" (W)×21" (H). It will be appreciated that the preceding list of panels are not exhaustive and that it will be apparent to one of ordinary skill in the art that other panel types may be used.

For example, exemplary controllers and brief descriptions of the same include the following: Somfy Telis 1 remote (one channel remote used to control RTS shades); Somfy Telis 4 remote (five channel remote used to control RTS shades); Somfy Keypad (five channel engraveable single gang in-wall keypad used to control RTS shades); Somfy Table Top Controller (table top case for Somfy Keypad); Somfy MyLink (plugs into wall outlet to allow app control of RTS shades); Somfy URTSII (multi-channel RTS transmitter used to integrate RTS shades with control systems); Somfy Connect (used to integrate with control systems and placed between the home control processor and URTSII); Somfy Repeater—Used to repeat the RTS command to extend range of the system; Crestron Mobile Pro App (used for RS485 motor control on any Android/iDevice). It will be appreciated that the preceding list of controllers are not exhaustive and that it will be apparent to one of ordinary skill in the art that other controller types may be used.

For example, exemplary accessories and brief descriptions of the same include the following: manual clutch insert piece—used to stop wear on inside of manual clutches over time (e.g., typically installed with manual clutches); RS232 to RS485 Converter; USB to DB9 Converter—used to communicate with RS485 motors from computer programs (e.g., used when setting limits and grouping motors). It will be appreciated that the preceding list of accessories are not exhaustive and that it will be apparent to one of ordinary skill in the art that other accessory types may be used.

For example, exemplary wire and brief descriptions of the same include the following: J-Wire—Branded wire which is a 14/2 pair for power and a 22/2 shielded pair for data (e.g., in Plenum and Non-Plenum); Crestron-HP; Lutron-RBL. It will be appreciated that the preceding list of wires are not exhaustive and that it will be apparent to one of ordinary skill in the art that other wire types may be used.

For example, exemplary compute programs and brief descriptions of the same include the following: Crestron Masterinstaller; Somfy SDN Motor Configurator; Somfy Legacy ILT Motor Configurator (e.g., can be used to get hidden node IDs). It will be appreciated that the preceding list of compute programs are not exhaustive and that it will be apparent to one of ordinary skill in the art that other compute programs may be used.

Referring now to FIGS. 10A-11D, hidden wire mounting bracket systems are shown according to exemplary embodiments. FIGS. 10A-10D are schematic illustrations of hidden wire mounting bracket systems according to exemplary embodiments. FIGS. 11A-11D are schematic illustrations of hidden wire mounting brackets according to exemplary embodiments. In some embodiments, the motor for the shade tube receives power and/or data from a wire running through the bracket. As shown, the wire is hidden in the bracket and is not visible to an observer because no visible wires are exposed externally with respect to the bracket and motor. For example, the hidden wire may be or include an eighth inch mini plug configured to provide both power and data to the motor through the same plug. By using the same plug to provide both power and data to the motor, and by configuring the system to run the plug through the center of the bracket, the motor is more easily connected and disconnected from the power and data source than conventional motors for shade tube assembly systems.

FIGS. 10A, 10B, and 11A-11D illustrate a hidden wire mounting bracket system or mounting assembly for a roller window shade, shown as mounting assembly 1000, according to a first embodiment. The mounting assembly 1000 is configured to mount a roller shade assembly 1002 to a flat, substantially vertical surface, shown as flat surface 1004. The flat surface 1004 may be part of a wall, a window jamb, or another building structure. The roller shade assembly 1002 includes a tubular member, shown as shade tube 1006, and a sheet of shade fabric, shown as shade 1008, which wraps around the shade tube 1006. Accordingly, rotation of the shade tube 1006 causes a corresponding raising or lowering of the shade 1008.

Figures 10A, 10B, 10C, 10D:
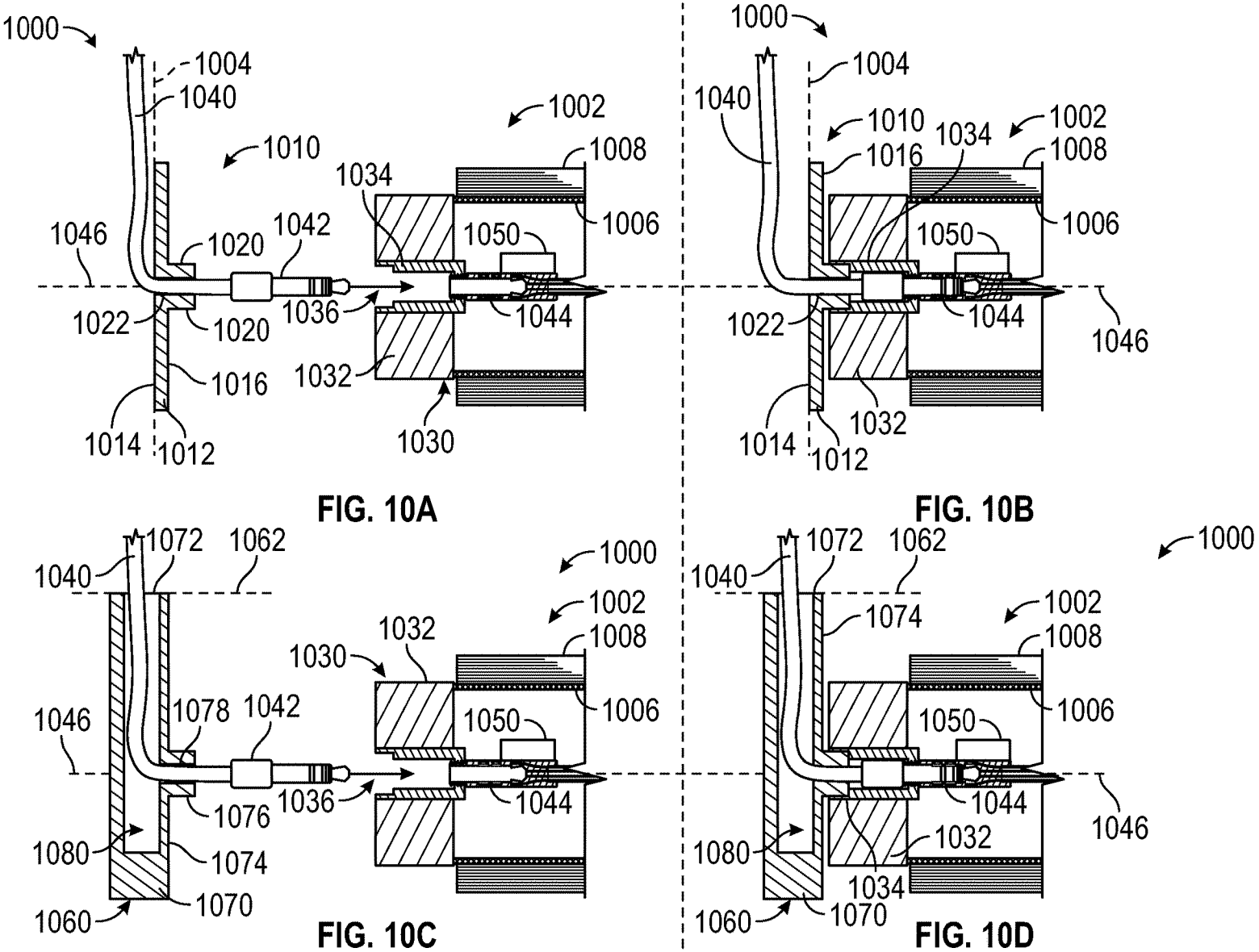
FIG. 10A is a schematic illustration of a hidden wire mounting bracket system in a separated configuration, according to an exemplary embodiment.
FIG. 10B is a schematic illustration of the hidden wire mounting bracket system of FIG. 10A in a connected configuration.
FIG. 10C is a schematic illustration of a hidden wire mounting bracket system in a separated configuration, according to another exemplary embodiment.
FIG. 10D is a schematic illustration of the hidden wire mounting bracket system of FIG. 10C in a connected configuration.
Figure 11C:
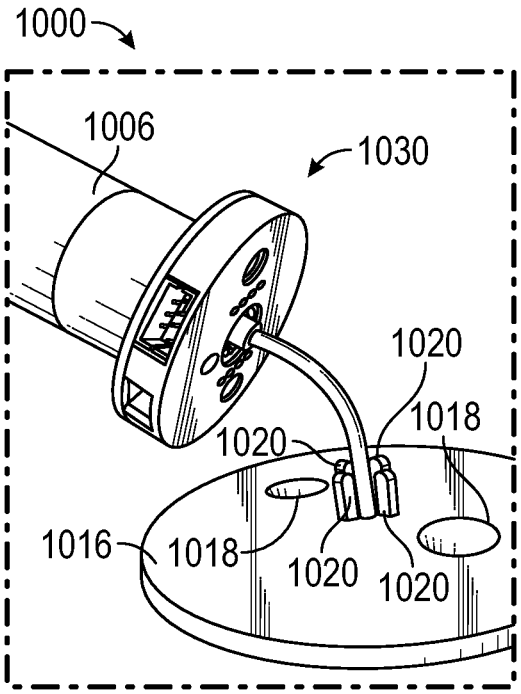
FIG. 11C is yet another schematic illustration of the hidden wire mounting bracket of FIG. 11A.

Referring to FIGS. 10A and 10B, the mounting assembly 1000 includes a mounting bracket 1010. The mounting bracket 1010 includes a base portion, base member, or body, shown as body 1012. The body 1012 is disc-shaped and has a first flat surface, shown as surface 1014, and a second flat surface, shown as surface 1016, positioned opposite the surface 1014. The body 1012 is coupled with the flat surface 1004 such that the surface 1014 bears against the flat surface 1004. As shown in FIG. 11C, the body 1012 defines a pair of mounting holes or fastener apertures, shown as apertures 1018, configured to receive fasteners to couple the mounting bracket 1010 to the flat surface 1004. Alternatively, the mounting bracket 1010 may otherwise be coupled with the flat surface 1004 (e.g., using adhesive). The mounting bracket 1010 further includes a series of projections or protrusions 1020 fixedly coupled with the body 1012 and extending outward from the surface 1016. As shown in FIG. 11C, the protrusions 1020 each have a rectangular cross section and arranged to form a cross or "plus" sign shape. The protrusions 1020 are arranged circumferentially about an aperture or passage 1022 that extends through body from the surface 1014 to the surface 1016. The mounting bracket 1010 may be formed from multiple separate pieces or integrally formed from a single piece. The mounting bracket 1010 may include more or fewer protrusions 1020.

The mounting assembly 1000 further includes an electric motor assembly, shown as motor 1030. The motor 1030 includes a first portion 1032 that is coupled with the shade tube 1006 and a second portion 1034 configured to rotate relative to the first portion 1032. The second portion 1034 defines a recess, pocket, or aperture, shown as recess 1036, configured to receive the protrusions 1020. The recess 1036 is correspondingly shaped to the protrusions 1020 such that, upon the protrusions 1020 being received within the recess 1036, the protrusions 1020 act as keys, preventing relative rotation between the mounting bracket 1010 and the first portion 1032 of the motor 1030. Accordingly, the second portion 1034 of the motor 1030 and the shade tube 1006 are configured to rotate relative to the mounting bracket 1010.

The mounting assembly 1000 further includes a wire or cable 1040 that is coupled with a power source (e.g., a power panel) and/or a data source (e.g., a controller such as a Somfy Telis 1 remote). The cable 1040 extends from the power source and/or data source through the flat surface 1004, through the passage 1022, and into the recess 1036. The protrusions 1020 are positioned proximate the passage 1022 to facilitate the cable 1040 exiting the passage 1022 and entering the recess 1036. In alternative embodiments having larger or differently spaced protrusions 1020, the passage 1022 may extend through one or more of the protrusions 1020. Positioned at an end of the cable 1040 distal from the power source and/or the data source is an electrical connector, shown as plug 1042. The motor 1030 further includes a port 1044 coupled with the second portion 1034 that is configured to receive the plug 1042. Once the port 1044 receives the plug 1042, electrical contacts on the plug 1042 and the port 1044 engage one another, electrically coupling the motor 1030 and the cable 1040. As shown in FIGS. 10A and 10B, the plug 1042 is a male eighth inch mini plug and the port 1044 is a female eighth inch mini plug. Accordingly, the plug 1042 and the port 1044 can be coupled or decoupled without the use of tools. In other embodiments, the gender and type of electrical connector of the plug 1042 and the port 1044 are varied.

The cable 1040 is configured to transfer electrical power from the power source to the motor 1030. The motor 1030 is configured to convert the electrical power into a rotational mechanical energy output, rotating the first portion 1032 relative to the second portion 1034. Accordingly, the first portion 1032 of the motor 1030 and the shade tube 1006 are both configured to rotate about a common axis of rotation, shown as axis 1046. As shown in FIGS. 10A and 10B, the axis 1046 extends substantially parallel to and through the center of the port 1044, the recess 1036, the plug 1042, the passage 1022, and the body 1012. Additionally, the protrusions 1020 are arranged in a pattern that is concentric with the axis 1046.

In some embodiments, such as the embodiment shown in FIGS. 10A and 10B, the motor 1030 further includes a controller 1050 configured to control operation of the motor 1030. The controller 1050 is configured to receive data from the data source through the cable 1040. The data may include operating commands, such as a command to raise or lower the shade 1008, a speed at which to raise or lower the shade 1008, or a schedule indicating when to operate the motor 1030 to raise and lower the shade 1008. Alternatively, the controller 1050 may be omitted, and the motor 1030 may be controlled by providing or not providing electrical power to the motor 1030 through the cable 1040.

Figure 11D:
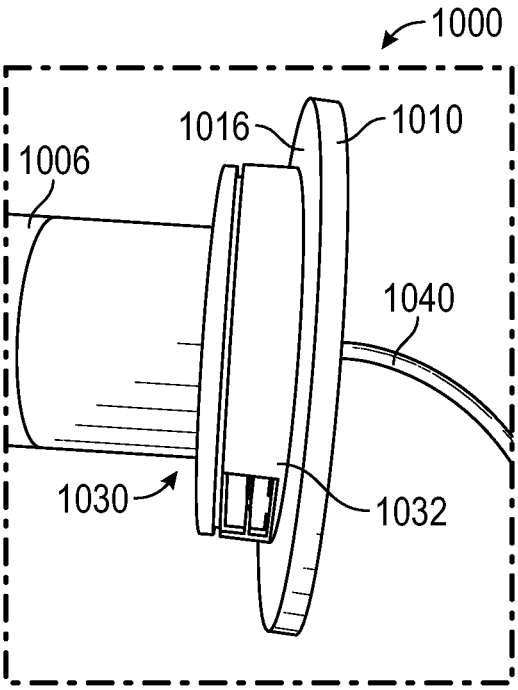
FIG. 11D is yet another schematic illustration of the hidden wire mounting bracket of FIG. 11A.

In a fully assembled configuration (e.g., where the surface 1014 bears against the flat surface 1004, the plug 1042 is received within the port 1044, and the protrusions 1020 are received within the recess 1036), the mounting bracket 1010 and the motor 1030 obscure the cable 1040 from view. A working length of the cable 1040 is defined between the flat surface 1004 and the motor 1030. The cable 1040 passes directly from the flat surface 1004 into the mounting bracket 1010, which surrounds the cable 1040. The cable 1040 then passes into the motor 1030, which also surrounds the cable 1040. As shown in FIGS. 10A and 10B, the protrusions 1020 may surround the cable 1040. Additionally or alternatively, as shown in FIG. 11D, the first portion 1032 and/or the second portion 1034 of the motor 1030 may directly contact the surface 1016. Accordingly, the working length of the cable 1040 is not visible to an observer positioned away from the mounting assembly 1000.

FIGS. 10C and 10D illustrate the mounting assembly 1000 according to an alternative embodiment. The embodiment shown in FIGS. 10C and 10D is substantially similar to the embodiment shown in FIGS. 10A and 10B, except the mounting bracket 1010 is replaced with a mounting bracket 1060. The mounting bracket 1060 is configured to mount the roller shade assembly 1002 to a flat, substantially horizontal surface, shown as flat surface 1062. The mounting bracket 1060 includes a base portion, base member, or body, shown as body 1070. The body 1070 is similar in shape to the R4W bracket shown in FIG. 9. The body 1070 has a first flat surface, shown as surface 1072, and a second flat surface, shown as surface 1074, oriented substantially perpendicular to the surface 1072. The body 1070 is coupled with the flat surface 1062 such that the surface 1072 bears against the flat surface 1062. The body 1070 is adhered, fastened, or otherwise coupled with the flat surface 1062. The mounting bracket 1060 further includes a series of projections or protrusions 1076 fixedly coupled with the body 1070 and extending outward from the surface 1074. The protrusions 1076 are substantially similar to the protrusions 1020. The mounting bracket 1060 may be formed from multiple separate pieces or integrally formed from a single piece. The mounting bracket 1060 may include more or fewer protrusions 1076.

The protrusions 1076 are arranged circumferentially about an aperture 1078 that extends from the surface 1074 partway through the body 1070. The body 1070 further defines a pocket, chamber, or recess 1080 that extends from the surface 1072 partway through the body 1070. The aperture 1078 intersects the recess 1080. Accordingly, the aperture 1078 and the recess 1080 cooperate to define a passage extending from the surface 1072 to the surface 1074, through which the cable 1040 extends. The protrusions 1076 are positioned proximate the aperture 1078 to facilitate the cable 1040 exiting the aperture 1078 and entering the recess 1036. In alternative embodiments having larger or differently spaced protrusions 1076, the aperture 1078 may extend through one or more of the protrusions 1076.

As shown in FIGS. 10A and 10B, the axis 1046 extends substantially parallel to and through the center of the port 1044, the recess 1036, the plug 1042, and the aperture 1078. The axis 1046 extends through the body 1070 and the recess 1080. Additionally, the protrusions 1076 are arranged in a pattern that is concentric with the axis 1046.

In a fully assembled configuration (e.g., where the surface 1072 bears against the flat surface 1062, the plug 1042 is received within the port 1044, and the protrusions 1076 are received within the recess 1036), the mounting bracket 1060 and the motor 1030 obscure the cable 1040 from view. A working length of the cable 1040 is defined between the flat surface 1062 and the motor 1030. The cable 1040 passes directly from the flat surface 1062 into the mounting bracket 1060, which surrounds the cable 1040. The cable 1040 then passes into the motor 1030, which also surrounds the cable 1040. As shown in FIGS. 10C and 10D, the protrusions 1076 may surround the cable 1040. Additionally or alternatively, the first portion 1032 and/or the second portion 1034 of the motor 1030 may directly contact the surface 1074. Accordingly, the working length of the cable 1040 is not visible to an observer positioned away from the mounting assembly 1000.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried out in addition to, or as substitutes to one or more of the steps disclosed herein.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

The construction and arrangement of the elements of the apparatus for shipping and installing shade tube assemblies and methods for shipping and installing shade tube assemblies as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. Some like components have been described in the present disclosure using the same reference numerals in different figures. This should not be construed as an implication that these components are identical in all embodiments; various modifications may be made in various different embodiments. It should be noted that the elements and/or assemblies of the enclosure may be constructed from any of a wide variety of materials that provide sufficient strength or durability, in any of a wide variety of colors, textures, and combinations. Furthermore, other substitutions, modifications, changes, and omissions may be made in the design, operating conditions, and arrangements of the exemplary embodiments without departing from the scope of the invention as expressed in the appended claims.

What is claimed is:

1. A mounting assembly for mounting a roller window shade comprising:

a frame having an exterior packaging;

a shipping tube disposed in the frame;

a sheet configured to be wrapped around the shipping tube when in transit;

a mounting bracket configured to be attached to a structure wherein the mounting bracket includes a body having a first flat surface and a second flat surface, wherein the first flat surface is perpendicular to the second flat surface, wherein the first flat surface is configured to bear against the structure and the second flat surface is configured to support a shade tube;

wherein the sheet is configured to be wrapped around a shade tube when the shade tube is supported by the mounting bracket;

a portion of the mounting bracket configured to be visible to an observer when the mounting bracket is attached to the structure;

a passage defined in the mounting bracket extending between the first flat surface and the second flat surface;

a motor configured to be coupled to the shade tube of the roller window shade a wire extending through the passage, the wire configured to be coupled with the motor and having a working length extending from the structure, through the mounting bracket and to the motor;

wherein the mounting bracket and the motor obscure the wire from view such that the working length of the wire is not visible to the observer.

2. The mounting assembly of claim 1, including a protrusion fixedly coupled with the body and extending perpendicularly from the second surface, wherein the protrusion is configured to engage the motor such that the protrusion prevents relative rotation between the mounting bracket and a portion of the motor.

3. The mounting assembly of claim 1, wherein the wire includes a first connector positioned at an end of the wire, and wherein the motor includes a second connector configured to selectively engage the first connector, thereby selectively electrically coupling the motor and the wire.

4. The mounting assembly of claim 3, wherein the first connector is a mini jack connector.

5. The mounting assembly of claim 1, wherein the wire is configured to transfer electrical power to the motor, and wherein the motor is configured to convert the electrical power into a mechanical energy output to rotate the shade tube.

6. The mounting assembly of claim 1, wherein the motor includes a controller configured to control rotation of the motor, wherein the wire is configured to transfer both electrical power and data to the motor, and wherein the controller is configured to control the motor to rotate the shade tube in response to the data received from the wire.

7. The mounting assembly of claim 1, wherein the motor and the shade tube are both configured to rotate about a common axis of rotation, and wherein the common axis of rotation extends lengthwise along the shade tube.

8. The mounting assembly of claim 1, wherein the body includes a rounded surface disposed opposite the first flat surface and configured to be visible to an observer when the mounting bracket is installed.

9. The mounting assembly of claim 8, wherein the body defines a pair of fastener apertures defined in the first flat surface and wherein the fastener apertures are each configured to receive a fastener therethrough to secure the mounting bracket to the structure.

10. The mounting assembly is claim 1 wherein:

the mounting bracket is a first mounting bracket;

the shade tube is a first shade tube;

the sheet is a first sheet; and, a second sheet is configured to be wrapped around the shipping tube when in transit and wrapped around a second shade tube when the second shade tube is supported by a second mounting bracket.

11. The mounting assembly is claim 10 wherein the second sheet is configured to be wrapped around the first sheet when in transit.

12. A fastening device for mounting a motorized roller window shade, the device comprising:

a shipping kit having a shipping tube;

a sheet disposed around the shipping tube when in transit;

a mounting bracket having a first flat surface and a second flat surface wherein the first flat surface is configured to bear against a structure and the first flat surface is perpendicular to the second flat surface, wherein the mounting bracket is configured to support a shade tube and the sheet is configured to be wrapped around the shade tube when the shade tube is supported by the mounting bracket;

a passage defined in the mounting bracket and extending from the first flat surface to the second flat surface configured to receive a wire therethrough; and wherein the mounting bracket is configured to obscure the wire such that a working length of the wire extending between the structure and a motor carried by the mounting bracket is not visible to an observer;

a rounded surface included on the mounting bracket and configured to be visible to an observer when the mounting bracket is attached to the structure.

13. The fastening device of claim 12, including a protrusion wherein the protrusion is configured to engage the motor such that the protrusion prevents relative rotation between the body and a portion of the motor.

* * * * *